US009862012B2

(12) United States Patent
Wieser et al.

(10) Patent No.: US 9,862,012 B2
(45) Date of Patent: Jan. 9, 2018

(54) APPARATUS FOR FORGING A HOLLOW BODY FROM A PRE-PERFORATED HOLLOW BLOCK

(71) Applicant: GFM—GmbH, Steyr (AT)

(72) Inventors: Rupert Wieser, Seitenstetten (AT); Robert Koppensteiner, Steyr (AT)

(73) Assignee: GFM—GmbH, Steyr (AT)

( * ) Notice: Subject to any disclaimer, the term of this patent is extended or adjusted under 35 U.S.C. 154(b) by 640 days.

(21) Appl. No.: 14/494,736

(22) Filed: Sep. 24, 2014

(65) Prior Publication Data

US 2015/0082846 A1 Mar. 26, 2015

(30) Foreign Application Priority Data

Sep. 25, 2013 (AT) ..... A 50617/2013

(51) Int. Cl.

| | |
|---|---|
| ***B21B 19/04*** | (2006.01) |
| ***B21B 25/02*** | (2006.01) |
| ***B21D 37/00*** | (2006.01) |
| ***B21J 13/08*** | (2006.01) |
| *B21J 7/14* | (2006.01) |
| *B21J 13/10* | (2006.01) |

(52) U.S. Cl.

CPC ..... *B21B 25/02* (2013.01); *B21D 37/00* (2013.01); *B21J 13/085* (2013.01); *B21J 7/14* (2013.01); *B21J 13/10* (2013.01)

(58) Field of Classification Search

CPC ..... B21B 25/02; B21B 19/04; B21J 13/085; B21J 7/14; B21J 13/10; B21D 37/00

USPC ..... 72/76, 97

See application file for complete search history.

(56) References Cited

U.S. PATENT DOCUMENTS

| | | | | |
|---|---|---|---|---|
| 3,753,365 A * | 8/1973 | Kralowetz | ..... | B21J 5/12 72/76 |
| 3,893,321 A * | 7/1975 | Braunwieser | ..... | B21J 7/14 42/78 |
| 7,434,434 B2 * | 10/2008 | Koppensteiner | ..... | B21J 5/10 72/76 |
| 8,459,085 B2 | 6/2013 | Muschalik et al. | | |

FOREIGN PATENT DOCUMENTS

| | | |
|---|---|---|
| DE | 553623 C | 11/1933 |
| DE | 2636636 A1 | 2/1978 |
| DE | 195 23 280 C2 | 1/1997 |
| DE | 10 2010 014 583 A1 | 10/2011 |
| EP | 2 218 526 A1 | 8/2010 |
| WO | 2012030244 A2 | 3/2012 |

* cited by examiner

*Primary Examiner* — David B Jones
(74) *Attorney, Agent, or Firm* — Collard & Roe, P.C.

(57) ABSTRACT

An apparatus for forging a hollow body from a pre-perforated hollow block includes forging tools that can be driven radially in relation to a forging axis, a clamping head which is displaceable on a guide bed in the direction of the forging axis and includes collet chucks for the hollow block, and a mandrel carriage which is arranged on the side of the clamping head facing away from forging tools, which is displaceable independently of the clamping head along the guide bed, and whose mandrel bar provided with the forging mandrel penetrates the clamping head coaxially to the forging axis. In order to provide advantageous constructional conditions the mandrel carriage includes an axial actuating drive for the mandrel bar and can be coupled in a tension-proof manner to the clamping head.

4 Claims, 4 Drawing Sheets

APPARATUS FOR FORGING A HOLLOW BODY FROM A PRE-PERFORATED HOLLOW BLOCK

CROSS REFERENCE TO RELATED APPLICATIONS

Applicant claims priority under 35 U.S.C. §119 of Austrian Application No. A50617/2013 filed Sep. 25, 2013, the disclosure of which is incorporated by reference.

BACKGROUND OF THE INVENTION

1. Field of the Invention

The invention relates to an apparatus for forging a hollow body from a preperforated hollow block, comprising forging tools that can be driven radially in relation to a forging axis, a clamping head which is displaceable on a guide bed in the direction of the forging axis and comprises collet chucks for the hollow block, and a mandrel carriage which is arranged on the side of the clamping head facing away from forging tools, which is displaceable independently of said clamping head along the guide bed, and whose mandrel bar provided with the forging mandrel penetrates the clamping head coaxially to the forging axis.

2. Description of the Related Art

For the purpose of forging long tubular hollow bodies from a pre-perforated hollow block it is known (EP 2 218 526 B1) to grip the hollow block in the region of a face end by the collet chucks of a clamping head comprising a through-hole which is coaxially to the collet chucks, so that the forging mandrel can be introduced by means of a mandrel bar through the through-hole of the clamping head into the hollow block for the subsequent forging of the hollow block between forging tools which can be actuated radially to the forging axis. This is ensured in such a way that the clamping head and the mandrel carriage accommodating the mandrel bar are independently displaceable from each other along a common guide bed. Since the forging mandrel is guided through the clamping head within the through-hole, the mandrel bar, which is offset in relation to the forging mandrel with respect to its diameter and is connected to a rotary drive in the mandrel carriage, requires a separate bearing element in order to enable centric guidance in the through-hole. This known forging apparatus is suitable for comparatively long tubular workpieces, but not for the forging of pre-perforated hollow blocks made of materials that are difficult to deform, because considerable forces occur between the clamping head and the mandrel carriage during the forging of such workpieces, which forces would need to be dissipated via the guide bed.

In order to reduce the overall length of forging apparatuses in which the perforated hollow block is clamped between a clamping head and a platen, it is further known (DE 195 23 280 C2) to mount the mandrel bar in the clamping head and to provide it with an axial actuating drive, so that the mandrel bar can be axially displaced for the purpose of forging hollow bodies in particular with an offset inside diameter in relation to the clamping head. Apart from the fact that the axial clamping of the preperforated hollow block between the clamping head and a platen requires additional construction work, there are also considerable limitations concerning the field of application of such forging apparatuses.

It is further known (DE 102010014583 A1) to provide carriages for the collet chucks and the mandrel bar which are displaceable on a common guide along the machine bed, of which the guide carriage for the collet chuck is driven by a spindle drive along the guide, whereas the mandrel carriage is connected to the guide carriage for the collet chuck by a further spindle drive. The mandrel carriage can thus be moved together with the guide carriage for the collet chuck along the machine bed, but can also be adjusted via the provided spindle drive in relation to the guide carriage for the collet chuck. Apart from the fact that the spindle drive between the guide carriage for the collet chuck and the mandrel carriage makes construction more complex and limits the adjusting possibilities for the mandrel carriage, the entire axial load of the mandrel carriage must be dissipated via the spindle drive for the mandrel carriage to the guide carriage for the collet chuck and from said carriage via its spindle drive to the machine bed.

The forging of a pre-perforated hollow block via a forging mandrel is used especially for economic reasons for tubular workpieces that need to be produced in comparatively small lots. This generally means that the forging apparatus needs to be a system with simple retooling features in order to enable the adjustment to different workpiece requirements. There is therefore a need in this connection to arrange an apparatus for forging hollow bodies in such a way that simple retooling can be ensured without having to accept any limitations in the field of applications such as the forging of comparatively long tubular hollow bodies or the forging of hollow bodies from a material that is difficult to deform.

SUMMARY OF THE INVENTION

Based on an apparatus of the kind mentioned above, this object is achieved by the invention such a way that the mandrel carriage comprises an axial actuating drive for the mandrel bar and can be coupled in a tension-proof manner to the clamping head.

As a result of this measure, the apparatus can be used in the known manner for forging comparatively long tubular workpieces, which requires a mandrel carriage which is independently displaceable with respect to the clamping head. The axial actuating drive for the mandrel bar in the mandrel carriage leads to the additional advantage over known forging apparatuses of this kind that the forging mandrel can be axially displaced even in the case of a mandrel carriage which is locked in relation to the guide bed. The tension-proof coupling between the mandrel head and the mandrel carriage represents an advantageous precondition for the forging of hollow bodies from a material that is difficult to deform, because the forces occurring between the clamping head and the mandrel carriage can be dissipated directly by the coupling and do not place any strain on the guide bed. The axial movement of the forging mandrel in relation to the clamping head which is necessary in the case of such a tension-proof coupling of clamping head and mandrel carriage is ensured by the axial actuating drive for the mandrel bar which is associated to the mandrel carriage. The axial forward feed of the hollow body to be forged in relation to the forging tools is conventionally achieved by way of a drive of the clamping head.

In order to meet the different forging requirements, the forging mandrel must additionally be rotated about its axis, wherein the rotating steps carried out during the return stroke of the forging tools can be performed within the terms of workpiece rotation via the collet chucks or opposite thereto. For this purpose, the mandrel carriage merely requires a respective rotary drive for the mandrel bar, which is triggered accordingly.

The temperature load on the forging mandrel can be limited by suitable cooling measures. The additional axial actuating drive for the mandrel bar offers the further possibility of axially displacing the forging mandrel in relation to the forging tools, so that the input of heat during the pressing of the workpiece against the forging mandrel which is required by the forging can be distributed over a longer longitudinal region of the forging mandrel. The same applies when the forging mandrel is displaced in relation to the forging tools in rotary steps. In order to enable maintaining advantageous working conditions in this respect, a control device can be provided for triggering the axial actuating drive and/or the rotary drive for the mandrel bar depending on the temperature of the forging mandrel. If the forging mandrel has a minimum length according to the travel of the axial actuating drive, then this leads to a length for the forging mandrel which is beneficial to an advantageous axial temperature distribution.

BRIEF DESCRIPTION OF THE DRAWINGS

The subject matter of the invention is shown in the drawings by way of example, wherein.

DETAILED DESCRIPTION OF PREFERRED EMBODIMENTS

Figure 1:
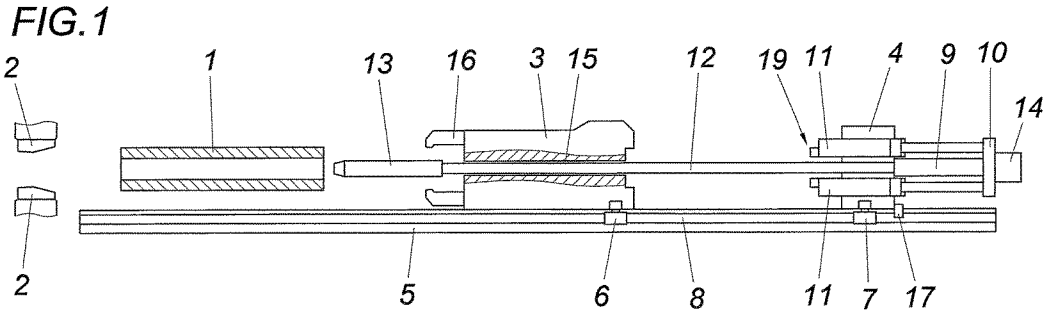
FIGS. 1 to 4 show an apparatus in accordance with the invention for forging a hollow body in different working positions in a simplified, purely schematic longitudinal sectional view.

The illustrated apparatus for forging a hollow body from a pre-perforated hollow block 1 comprises forging tools 2 which can be driven radially in relation to a forging axis and which are provided upstream with a clamping head 3 and a mandrel carriage 4. The clamping head 3 and the mandrel carriage 4 are displaceably mounted on a common guide bed 5 and can be displaced independently from each other via travel drives 6 and 7 along the common guide bed 5. The travel drives 6, 7 may comprise drive pinions which engage in a toothed rack 8 for example.

The mandrel carriage 4 is provided with a mandrel bar receptacle 9, which can be displaced axially by means of an actuating drive 10. Actuating cylinders 11 are indicated as the actuating drive 10. In order to allow the mandrel bar 12 with the forging mandrel 13 to be displaced axially not only in relation to the mandrel carriage 4 but also to enable rotation about the mandrel axis in rotary steps, the mandrel bar receptacle 9 which is respectively rotatably mounted is connected to a rotary drive 14.

The clamping head 3 is penetrated by the mandrel bar 12 in a guide opening 15, wherein the forging mandrel 13 protrudes axially beyond the clamping head 3 and extends coaxially to the collet chucks 16 of the clamping head 3, by means of which the hollow block 1 to be forged is chucked in a manner suitable for forging. The preperforated hollow block can be provided with a configuration that is closed off in the region of one end. It needs to be clamped in the region of its open end however.

Figure 2:
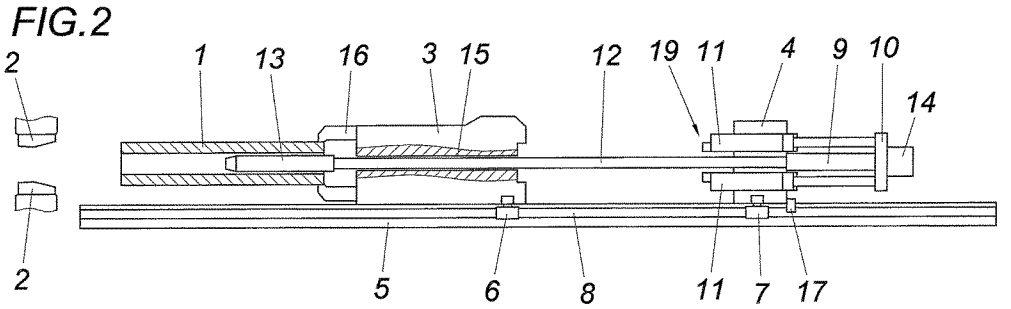
Figure 3:
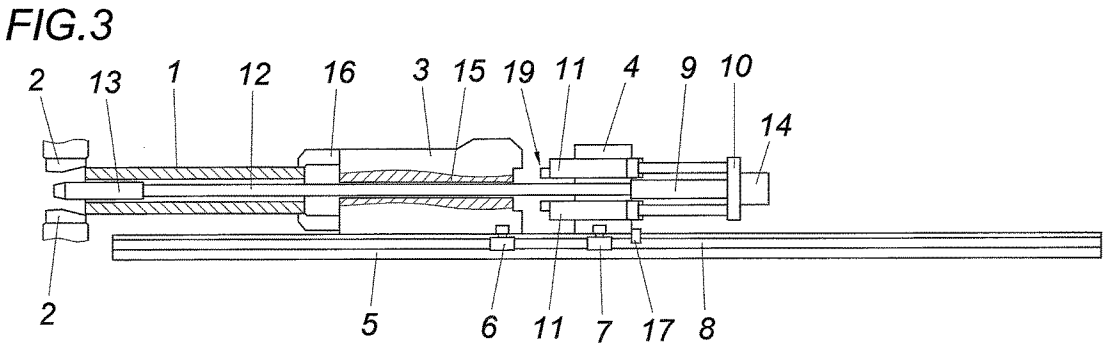

As is shown in FIG. 1, the clamping head 3 and the mandrel carriage 4, which is provided for clamping the pre-perforated hollow block 1 held in a loading position coaxial to the forging axis, are displaced against the forging tools 2, wherein the forging mandrel 13 is inserted into the opening of the hollow block 1 and the collet chucks 16 grip the hollow block, as is shown in FIG. 2. The hollow block 1 which is clamped in this manner can now be displaced to a forging position according to FIG. 3, in which the forging mandrel 13 is advanced by means of the mandrel carriage 4 between the forging tools 3 through the hollow block 1, as shown in FIG. 3. In this displacement position, the mandrel carriage 4 is locked to the guide bed 5 via a locking device 17. The hollow block 1 can thus be subjected to a respective forward feed by the clamping head 3 for forging via the forging mandrel 13, wherein the axial forward feed via the travel drive 6 can be superimposed by a rotary forward feed via the respectively driveable collet chucks 16. During the forging process, the axial actuating drive 10 for the mandrel bar 12 can be actuated via a control device, so that the forging mandrel 13 is displaced in the axial direction in relation to the forging tools 2. Said axial displacement of the forging mandrel 13 can be used to forge a hollow body which is offset with respect to its inside diameter when the forging mandrel 13 comprises respectively offset diameter regions. The displacement of the forging mandrel 13 in relation to the forging tools 2 can also be advantageously used to reduce the temperature load on the forging mandrel 13 because the axial displacement of the forging mandrel 13 allows a distribution of the heat quantity over the length of the mandrel which is transmitted during the loading by forging via the forging tools. Advantageous constructional conditions are obtained in this connection when the mandrel length corresponds at least to the actuating distance of the axial actuating drive.

Figure 4:
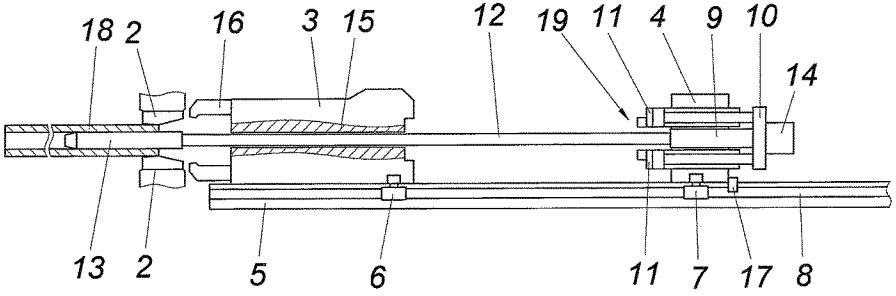

FIG. 4 shows the end of the forging process. The hollow body 18 forged from the pre-perforated hollow block 1 is released in the conventional manner by the collet chucks 16 of the clamping head 3 in order to pull it from the opposite end between the forging tools 2 for forging the end of the hollow body. The illustration shows that the forging mandrel 13 was displaced accordingly via the axial actuating drive 10 of the mandrel carriage 4 in relation to its initial position according to FIG. 3.

Figure 5:
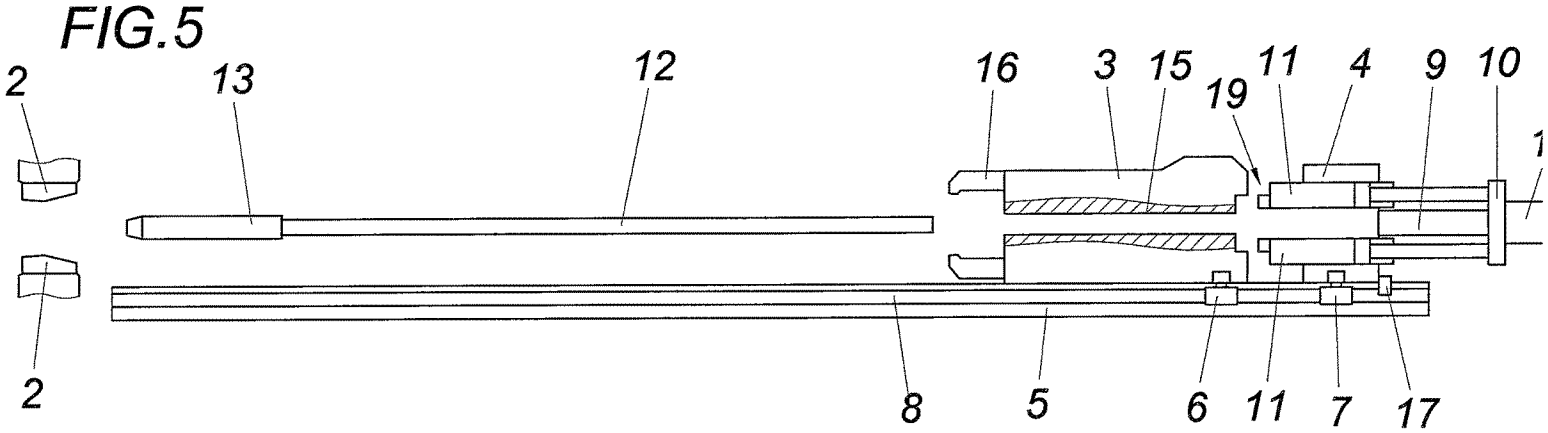
FIG. 5 shows the position of the apparatus for exchanging a mandrel bar.

FIG. 5 shows the position of the apparatus for exchanging the mandrel. The forging mandrel 13 with the mandrel bar 12 is pulled from the side of the collet chucks 16 out of the mandrel bar receptacle 9 of the mandrel carriage 4 through the guide opening 15 out of the clamping head 3, which is displaced for this purpose together with the mandrel carriage 4 to the end of the guide bed 5 facing away from the forging tools 2. The forging mandrel 13 which is released in this manner can thus be changed together with the mandrel bar 12 and a new forging mandrel with a mandrel bar 12 can be inserted in the reverse direction through the guide opening 15 of the clamping head 3 into the mandrel bar receptacle 9 of the mandrel carriage 4.

Figure 6:
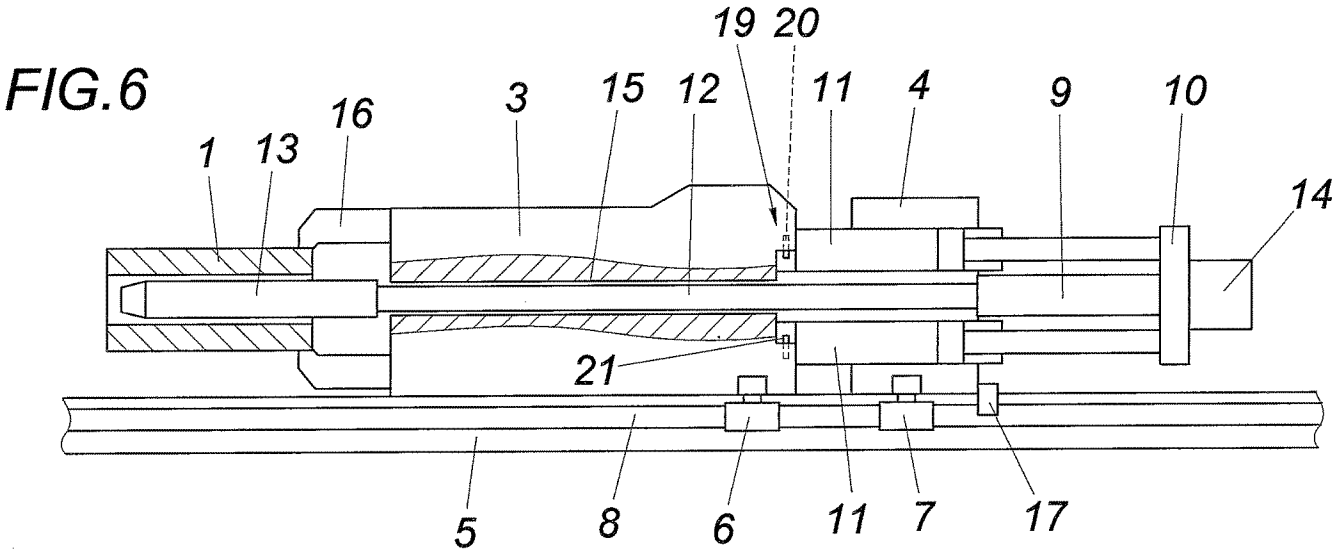
FIG. 6 shows the clamping head and the mandrel carriage in the coupling position on an enlarged scale.
Figure 7:
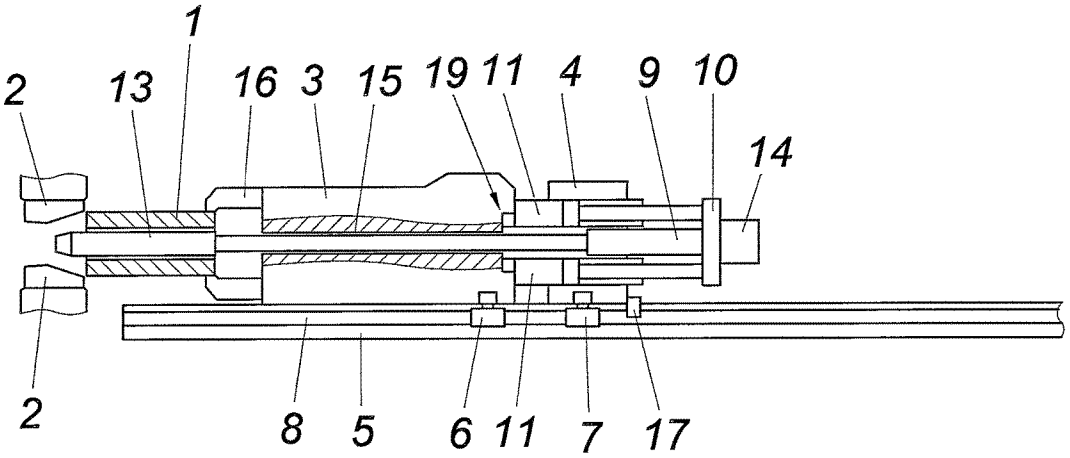
FIG. 7 and FIG. 8 show two different working positions for the clamping head coupled to the mandrel carriage.
Figure 8:
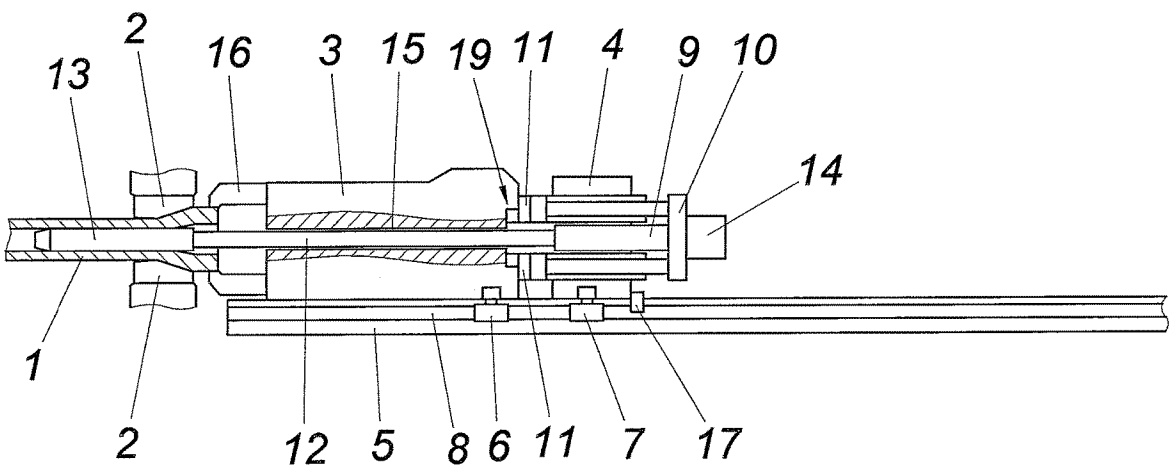

As is shown in FIG. 6, the clamping head 3 and the mandrel carriage 4 can be locked together in a tension-proof manner by means of a coupling device 19. Locking can occur by locks 20 which releasably engage into radial lock recesses 21, so that the clamping head 3 with the mandrel carriage 4 is connected mechanically into a modular unit which absorbs the axial forces occurring between the collet chucks 16 and the forging mandrel 13 without loading the guide bed 5. In the coupling position according to FIG. 6, hollow bodies can be forged in which high deformation forces are necessary. FIGS. 7 and 8 show the forging of a hollow body from a preperforated hollow block 1 that is difficult to deform for example, wherein the modular unit formed by the clamping head 3 and the mandrel carriage 4 is displaced against the forging tools 2 via the travel drive 6 of the clamping head 3. The forging mandrel 13 therefore requires a length corresponding to the length of the hollow block 1 when the forging mandrel is not displaced by the actuating drive in opposite direction to the forging forward feed of the hollow block. In the case of short hollow blocks 1, it may be advantageous under certain circumstances that the forging mandrel 13 is displaced in addition in the forward feed direction of the clamping head 3, which requires lengthening of the forging mandrel 13. FIG. 8 shows the position in which the clamping head 3 needs to release the hollow block 1 in order to enable completing the forging of the hollow block 1.

What is claimed is:

1. An apparatus for forging a hollow body from a pre-perforated hollow block, comprising a guide bed, a mandrel bar provided with a forging mandrel, forging tools that are driven radially in relation to a forging axis, a clamping head mounted on the guide bed for displacement in the direction of the forging axis and comprising collet chucks for the hollow block on a first side of the clamping head, and a mandrel carriage which is arranged on a second side of the clamping head opposite to the first side, wherein the mandrel carriage is displaceable independently of said clamping head along the guide bed, and wherein the mandrel bar provided with the forging mandrel penetrates the clamping head coaxially to the forging axis, wherein the mandrel carriage comprises an axial actuating drive for the mandrel bar and is coupled to the clamping head in a manner ensuring tensile strength.

2. The apparatus according to claim 1, wherein the mandrel carriage comprises a rotary drive for the mandrel bar.

3. The apparatus according to claim 2, wherein a control device is provided for triggering the axial actuating drive and/or the rotary drive for the mandrel bar depending on the temperature of the forging mandrel.

4. The apparatus according to claim 1, wherein the forging mandrel has a minimum length corresponding to an actuating distance of the axial actuating drive.

* * * * *